United States Patent [19]

Grantham

[11] Patent Number: 4,464,159

[45] Date of Patent: Aug. 7, 1984

[54] SHOP TOWEL FOLDER

[76] Inventor: Frederick W. Grantham, 12055 Goshen Ave., Los Angeles, Calif. 90049

[21] Appl. No.: 503,259

[22] Filed: Jun. 10, 1983

Related U.S. Application Data

[63] Continuation of Ser. No. 405,900, Aug. 6, 1982, abandoned, which is a continuation of Ser. No. 230,459, Feb. 2, 1981, abandoned.

[51] Int. Cl.[3] ..... B65H 45/14

[52] U.S. Cl. ..... 493/419; 223/37; 414/92

[58] Field of Search ..... 493/441, 444, 446, 455, 493/457, 458, 419, 249; 223/37; 414/92

[56] References Cited

U.S. PATENT DOCUMENTS

| | | | |
|---|---|---|---|
| 3,339,914 | 9/1967 | Grantham | 493/458 X |
| 3,342,386 | 9/1967 | Rademacher | 223/37 |
| 3,462,138 | 8/1969 | Grantham | 493/444 X |
| 3,774,903 | 11/1973 | Sjoman | 223/37 X |
| 4,059,258 | 11/1977 | Grantham | 270/67 |
| 4,060,227 | 11/1977 | Landgraf | 493/458 X |

*Primary Examiner*—A. J. Heinz

*Attorney, Agent, or Firm*—Henry M. Bissell

[57] ABSTRACT

An automatic folding machine especially adapted for shop towels. Such items, when fed into the machine, are automatically advanced from the feed board, dropped onto a belt where they fold by gravity about a center line, advanced in stacks of ten (or some other preselected number), rotated through 90° to a horizontal attitude and discharged onto a conveyor table. After five such stacks (as determined by the operator) are accumulated in a bundle, the conveyor advances the bundle to a tying machine for tying to complete the processing.

The machine includes settable counters, separate towel count and stack count registers and related control and timing elements to achieve automatic operation of the functional components. A pacer light, controlled by a timer, is also provided to improve the feed rate established by the operator.

14 Claims, 6 Drawing Figures

SHOP TOWEL FOLDER

This is a continuation of application Ser. No. 405,900 filed Aug. 6, 1982, which is a continuation of application Ser. No. 230,459 filed Feb. 2, 1981, both of which are now abandoned.

BACKGROUND OF THE INVENTION

1. Field of the Invention

This invention relates to the field of automatic material folding machines and, more particularly, to machines for automatically folding small, flat cloth articles such as shop towels.

2. Description of the Prior Art

A major cost associated with commerical laundering operations stems from the folding of the laundered articles so that they may be easily handled, neatly stored and readily dispensed. Manual folding, when large quantities of laundered articles are involved, is relatively time-consuming and thus may be very expensive. The cost per item attributable to this step in the laundering process is greater for small items than for large items, such as sheets and the like. Accordingly, there is a substantial need for machines for automatically folding the laundered articles in a continuous flow manner.

Various apparatus for automatic folding of commercially laundered items are the subjects of my prior patents, U.S. Pat. Nos. 3,462,138 and 4,059,258. U.S. Pat. No. 3,462,138 relates to the "Iron Woman" automatic folding machine for small articles which will automatically make a center fold or a french fold and then a cross fold, and which is adaptable for use with laundered articles having sizes up to about 2'×4'. Such machines are particularly useful when large quantities of a single type and single size of article, for example towels, napkins or diapers, are involved. Unfolded, flat laundered items are continuously fed into one end of the machine, and folded items are continuously delivered from the other end of the machine.

U.S. Pat. No. 4,059,258 discloses a particular type of automatic folding apparatus in which a second fold may be selectively developed in a previously folded article.

There is a particular need, not fulfilled by either of the disclosed machines, for the folding of shop towels. These are the wiping cloths, commonly used by mechanics, service station attendants and the like, which are typically about 1 ft. square. Customarily, these are not folded individually, but are rather placed in stacks of ten towels, folded double, with five of the thus-folded stacks tied together in a bundle for shipment to the customer. The folding of shop towels may be done on a rough basis; precise folding and pressing is not required as in the case of sheets, pillow cases, table cloths and the like. However, relatively high speed in the handling of the shop towels through the bundling, folding, stacking and typing process is important if the cost attributable to the process is to be kept within manageable limits. This consideration militates toward a folder which not only accepts and processes the shop towels from the operator at a rate which exceeds the maximum feed rate of the operator, but which can encourage the individual operator to improve her maximum feed rate.

SUMMARY OF THE INVENTION

In brief, arrangements in accordance with the present invention comprise a plurality of conveyors and processing mechanisms for shop towels or the like, controlled by associated timing of the control mechanisms and coordinated in an overall system to develop an automatic shop towel folder. At the input end of the folder, an operator places individual shop towels on the first portion of a feed board conveyor. This is driven by a second portion of the feed board conveyor which, by virtue of sprocket drive coupling between the two portions, operates at twice the speed of the first portion. As a result, as soon as a shop towel reaches the transition point between the first and second portions of the feed board conveyor, it is rapidly pulled off of the first portion, leaving a space for the operator to place the next towel in position.

From the feed board conveyor, the shop towel is propelled by another, overhead conveyor along a pair of stainless steel "flippers". When the shop towel reaches a predetermined position on the flippers, it interrupts the beam from an associated photocell, triggering the flippers to pivot downwardly and drop the towel onto a centrally positioned, longitudinally aligned belt of the V-type. The shop towel thus is folded along its center as it drops onto the V-belt. This belt, when operative, propels the shop towel forward to engagement by a transition conveyor, comprising a pair of opposed belts oriented about vertical rollers at the input end and transitioning to a horizontal attitude about horizontal rollers at the output end. In one preferred embodiment, the upper one of the two transition belts extends at the outlet end over a second pair of pivotable flippers. Appropriate counters and timers are incorporated to control the operation of the respective belts and conveyors in the manner to be described.

In operation, interruption of the photocell beam by a shop towel as it is fed into the automatic folder triggers a clutch and brake mechanism which momentarily stops the overhead conveyor. At the same time, an actuation signal energizes a pneumatic actuator to pivot the flipper mechanism and drop the towel onto the V-belt. The drive for the V-belt is controlled in response to a counter and is energized only after a predetermined number (preferably 10) of towels have been dropped onto the V-belt. Upon actuation of the V-belt drive mechanism, the bundle of 10 towels, folded double about a longitudinal line, is propelled into the continuously running transition conveyor which carries the bundle along, orients it from a vertical to a horizontal attitude, and propels it over the second pair of flippers. The second pair of flippers is actuated in a manner corresponding to the first pair of flippers, except that the control for actuating the second pair of flippers is responsive to an output signal from a delay timer that is energized concurrently with the signal activating the V-belt drive mechanism. In an alternative arrangement, the second pair of flippers (the outlet flippers) is activated in response to a signal from a second photocell responsive to the presence of a bundle of folded towels on the outlet flippers.

Activation of the outlet flippers causes them to rotate and drop the bundle of shop towels onto a table having a further conveyor leading to a tying machine. This tying machine conveyor is controlled to be energized from the output of a stack counter which counts the number of stacks dropped on the table—i.e. the number of times the outlet flippers are cycled—and at a predetermined count (preferably five) advances the bundle of five stacks, ten towels in each stack to the tying machine.

As a further feature of the present invention, a "pacer" light is incorporated to enable the operator to match the rate at which shop towels are fed into the machine to the rate of operation of the machine. A light bulb is mounted on the folder in a position where it is visible to the operator. A pacer light timer is provided which is reset each time it receives a signal from the photocell adjacent the first pair of flippers. After a predetermined time interval, the pacer light timer times out and causes the pacer light to be energized, thus indicating to the operator that the feed rate must be increased to match the operating rate capability of the folder. The ratio of on time to off time of the pacer light during the feeding operation is a measure of the rate at which the operator is feeding towels into the folder, and can serve as an incentive for the operator to increase the feed rate if the light is illuminated frequently, the objective being to keep the light from coming on.

Auxiliary contol and indicating equipment may be incorporated, such as registers at each end of the machine, one for counting the number of towels being folded and the other for counting the number of bundles being turned out by the folder, as well as selectors for setting the count of the towel counter and the stack counter, plus reset buttons in the front and back of the machine for selectively resetting either the towel counter or the stack counter.

BRIEF DESRIPTION OF THE DRAWING

A better understanding of the present invention may be had from a consideration of the following detailed description, taken in conjunction with the accompanying drawing in which.

DESCRIPTION OF THE PREFERRED EMBODIMENT

Figure 1:
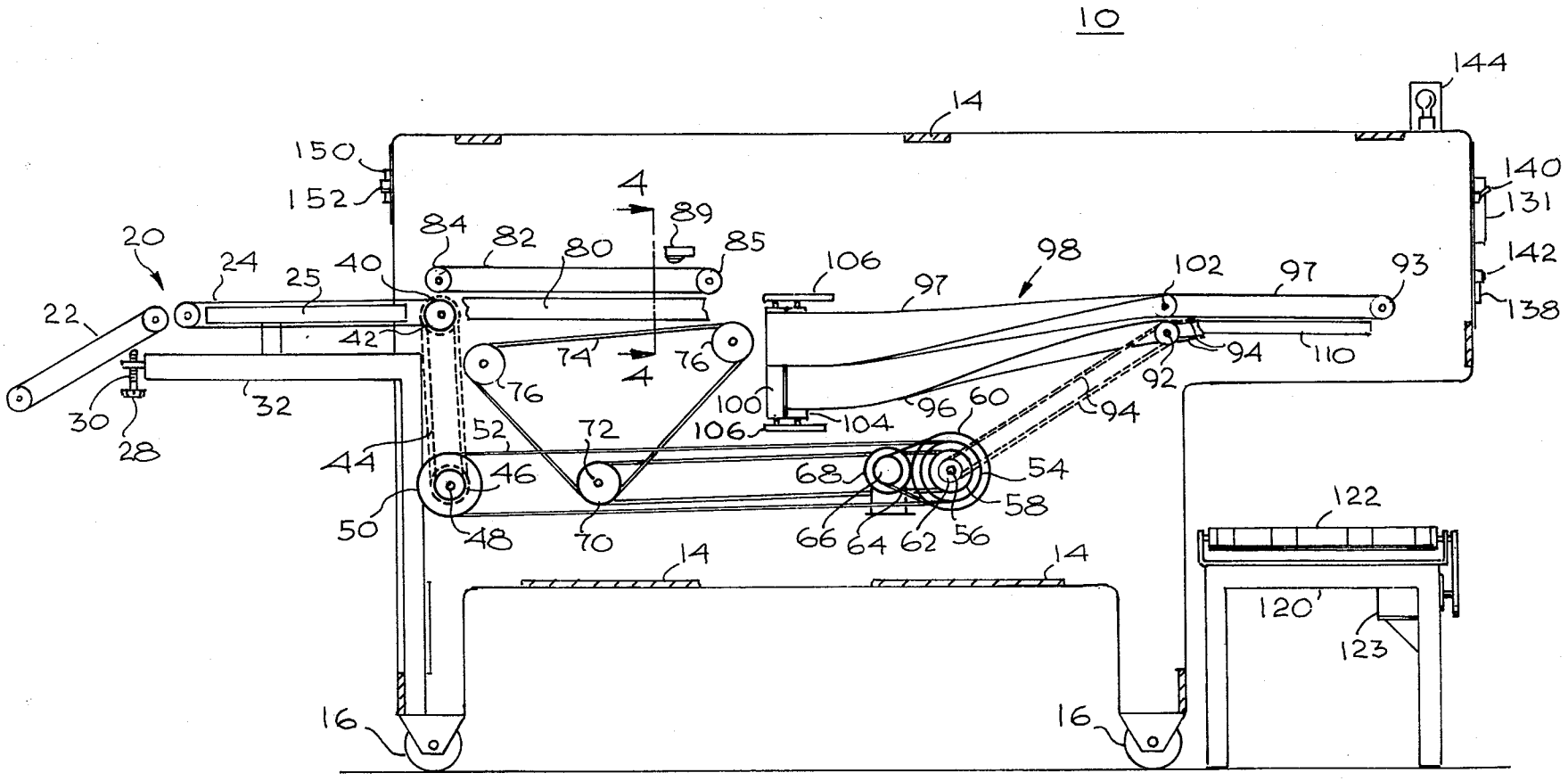
FIG. 1 is a schematic diagram of the preferred embodiment of the invention, viewed from the side with the near-side plate removed.
Figure 2:
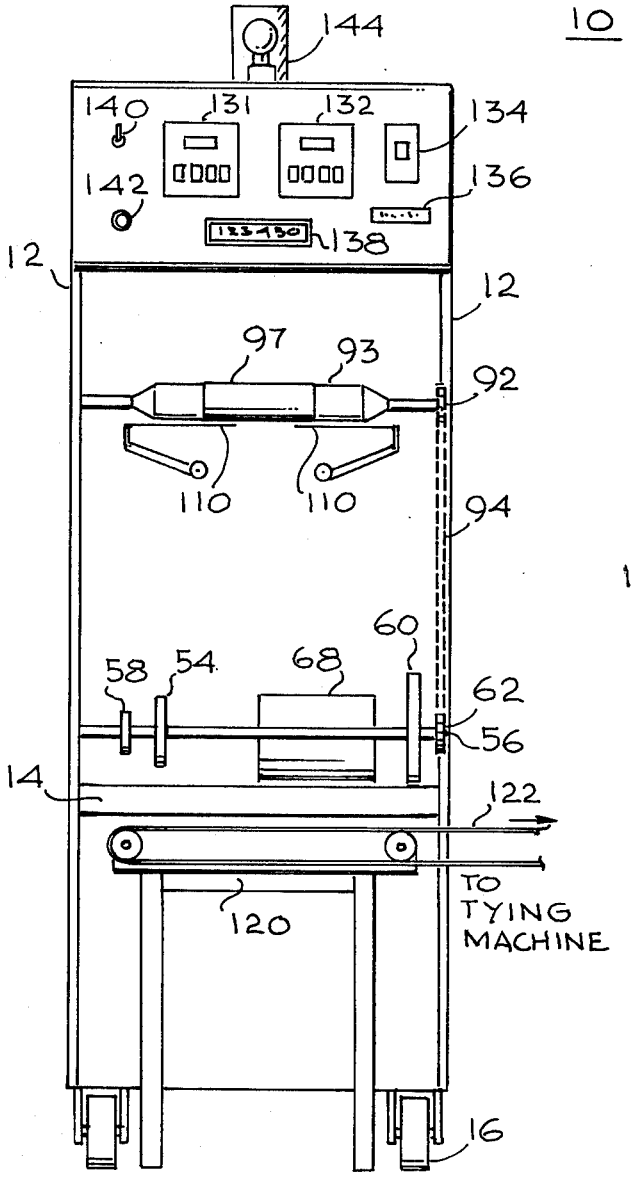
FIG. 2 is an end view of the arrangement of FIG. 1, viewed from the right-hand end of the machine as it appears in FIG. 1.
Figure 3:
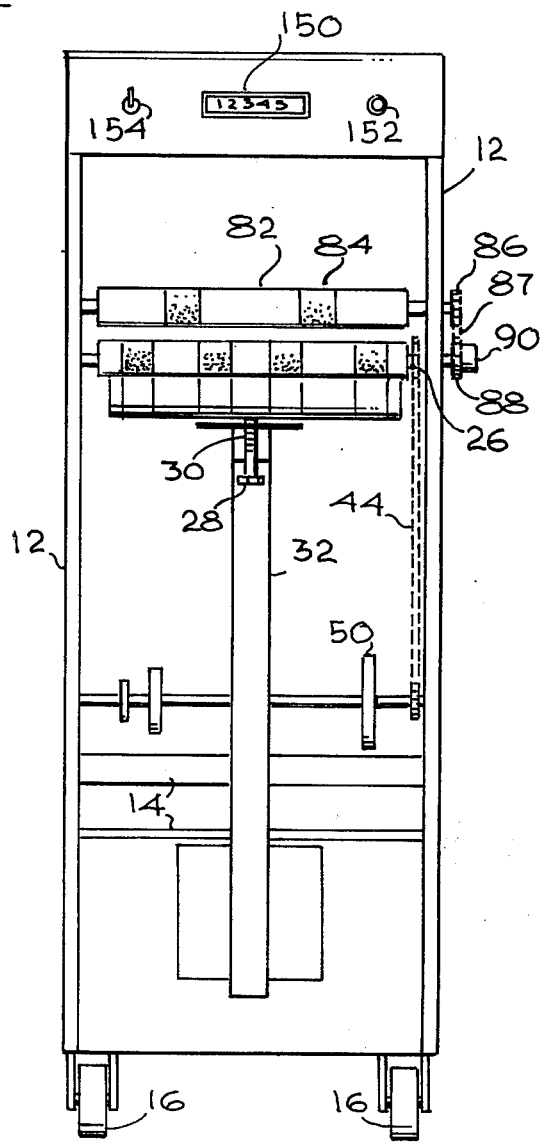
FIG. 3 is a view of the opposite end of the machine of FIG. 1.

As particularly shown in the views of FIGS. 1–3, the shop towel folder 10 embodying the present invention comprises a pair of side plates 12 fastened together by cross members 14 and supported on wheels or rollers 16. The side plates 12 constitute the frame from which the various elements making up the folder are supported. At the input or rear end of the folder 10, a feed board conveyor 20 is shown comprising a first portion 22 coupled to a second portion 24 by means of a sprocket and chain drive 26. The sprockets of the chain drive 26 are related in a two-to-one ratio so that the second portion 24 of the feed board conveyor transports the shop towels at twice the rate provided by the first portion 22. It will be noted that the elevation and angle of the first portion 22 are adjustable by means of a hand wheel 28 and screw 30 mounted in the support frame 32.

Conveyor belts in the second portion 24 of the feed board conveyor extend around a roller 40 which has an end sprocket 42 coupled by a drive chain 44 to another sprocket 46 on a cross shaft 48. This cross shaft also has a pulley 50 which in turn is driven by a belt 52 from another pulley 54 on a jackshaft 56. The jackshaft 56 carries a number of additional pulleys 58 and 60, together with a sprocket 62. The pulley 60 is driven via the belt 64 from a pulley 66 on an electric motor 68. The pulley 58 drives another pulley 70 mounted on a cross shaft 72. The pulley 70 is coupled to the cross shaft 72 by means of an electrically actuated clutch (not shown).

A V-belt 74 is mounted on three pulleys, the two pulleys 76 and another pulley (not shown) on the cross shaft 72. The V-belt 74 and its associated pulleys are mounted in a central location between the sides of the machine. Above the level of the V-belt 74 is a pair of flippers 80 (see FIGS. 4A and 4B for details) which extend to either side of the pulley 74. Above the flippers 80 is an overhead conveyor 82 which moves about rollers 84, 85. The drive roller 84 is coupled by a sprocket 86 and chain 87 to another sprocket 88 (see FIG. 3) on the drive roller 40 of the feed board conveyor portion 24. The sprocket 88 is actually coupled to the shaft of the drive roller 40 by means of a clutch/-brake mechanism 90. A photocell 89 is also positioned above the flippers 80 to respond to reflected light from th flippers 80.

The sprocket 62 of the jackshaft 56 drives a pair of drive rollers 92, 93 by means of a chain 94. These drive rollers 92, 93 are associated respectfully with a pair of belts 96, 97 making up the transition conveyor 98. The belt 97 extends about a vertical roller 100 and the two horizontal rollers 93 and 102. The belt 96 extends about a vertical roller 104 and the horizontal roller 92. Vertical rollers 100, 104 are supported between upper and lower frame supports 106. Beneath the extended portion of the belt 97 is a pair of flippers 110 mounted on opposite sides of the center plane of the machine and pivotable to drop a stack of folded shop towels when signalled to do so.

A transverse conveyor table 120 with conveyor 122 and drive motor 123 receives stacks of folded towels from the flippers 110 and transports them to a tying machine (not shown) for typing into bundles.

As particularly shown in FIG. 2, the folder is equipped with a number of switches, counters, indicators and the like for controlling the operation of the folder, principally located at the front or output end of the machine. As shown in FIG. 2, these comprise settable control units 131, 132, a master power switch 134, a voltage indicator 136, a stack register 138, a sub-control switch 140 and a reset button 142. The units 131, 132 permit the operator to select the cycle for the towel counter and the stack counter, respectively. The towel counter counts the number of towels in a stack and provides an output signal when the preselected number is reached. The stack counter operates similarly to count the stacks dropped on the conveyor table 120 and provides an output signal when the preselected number is reached. The register 138 provides an overall count of the stacks of folded towels processed through the folder. The reset button 142 enables an operator to start the register 138 over at count zero. Switch 134 controls power to the folder; toggle switch 140 controls power to the motor, thus permitting the operator to interrupt the drive to the moving machinery in the folder without affecting the electronic circuitry, the counters, registers, etc.

A light 144 is mounted on top of the folder near the output end. This light is visible to the operator at the feed board end and functions as a pacer light, turning on at the end of a preset time delay following the interruption of the beam of the photocell 89 by the appearance of a shop towel on the flippers 80. The pacer light timer is reset with each pulse from the photocell 89; thus, as long as the operator keeps feeding shop towels into the folder at time intervals less than the preset cycle time for the pacer light timer, the pacer light does not turn on. As soon as the operator slows below a corresponding rate, however, the pacer light 144 will be energized, thus signalling the operator (and any observer in the vicinity) that the operator's feed rate need to be increased.

At the rear or feed board end of the folder 10 (see FIG. 3) a register 150, reset button 152 and toggle switch 154 are mounted in full view of the operator. The register 150 provides a running count of the towels or other items fed into the folder. The reset button 152 permits the operator to reset the register 150 to count zero. The toggle switch 154 serves the same purpose as the switch 140 (FIG. 2) to permit the operator to turn off the drive motor without interrupting power to the counters, timers, and other electronic components.

Figure 4A:
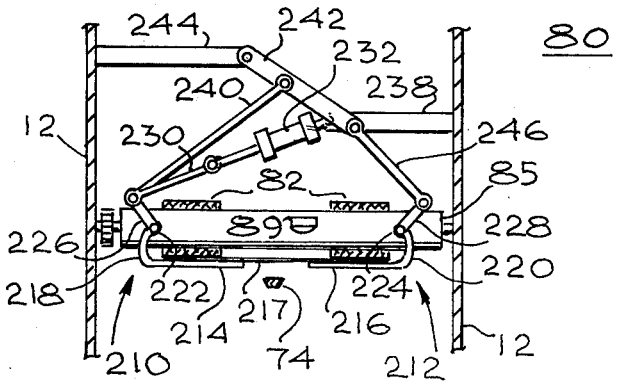
FIGS. 4A and 4B are sectional views of a particular portion of the embodiment of FIG. 1, taken along the line 4—4 and illustrating the operation of the depicted structure.
Figure 4B:
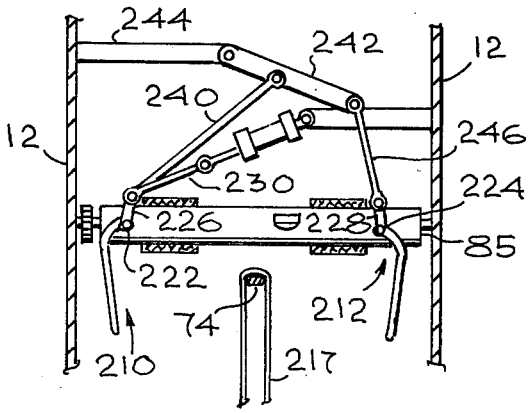

A typical flipper assembly for the flippers 80 is depicted in the sectional views of FIGS. 4A and 4B, showing respectively the positions of the flippers before and after release of a shop towel placed thereon. The assembly of FIGS. 4A and 4B corresponds to the flippers 80 at the input end of the folder 10; however, the discharge flippers 110 at the output end are essentially the same in structural configuration and operation.

The assembly 80 of FIGS. 4A and 4B comprises an opposing pair of shaped flipper blades 210, 220 which have, in the normal article-conveying configuration shown in FIG. 4A, flat horizontal portions 214 and 216, respectively, upon the upper surfaces of which articles such as the shop towel 217 are conveyed, driven by the belts 82 shown extending about the roller 85. The blades 210, 212 have generally vertical side portions 218, 220 respectively, which curve upwardly around lower portions of the belts 82, between the rollers 84, 85, and are pivotably mounted to structure (not shown) at upper edges of such side portions by shafts 222 and 224, respectively. Operating arms 226 and 228 are affixed to upper edges of the blade sides 218 and 220, respectively, being direcged generally outwardly. Pivotably mounted to the free arm 226 is a push rod 230 which is connected to a pneumatic cylinder 232, operation of which is controlled by a solenoid valve or the like which is connected thereto but not shown in this drawing. An upper end of the cylinder 232 is pivotably mounted to a bracket 238 which projects inwardly from the sidewall 12. For operation of the flipper blade 212, one end of a link 240 is also pivotably mounted to the free end of the arm 226. The other end of the link 240 is connected to a bar 242 which is pivotably connected at an upper end to a bracket 244 fastened to the other sidewall 12. A link 246 is pivotally connected at one end to a lower portion of the bar 242 and, at its other end, to the free end of the arm 226 coupled to the blade 212.

In operation of the flipper assembly, the actuator 232 is energized to retract the rod 230, thus pivoting the arm 226 and attached blade 210 about the pivot axis 222 and opening the blade 210. This same action causes the rod 240 to similarly pivot the arm 228 and attached blade 212 about the pivot axis 224 through the links 246, 242, thereby causing the blades 210, 212 to assume the open position shown in FIG. 4B. As a result, the shop towel 217 drops down and folds along its center line on the V-belt 74. Succeeding shop towels 217 are dropped in similar fashion where they remain draped on the belt 74 on top of preceding folded towels 217 until the predetermined number of towels are in position, at which time the belt drive mechanism is energized to propel the folded stack forward into the transition conveyor 98 (see FIG. 1). Equivalent flippers and control structure are provided for the discharge flippers 110 for corresponding operation with respect to the stacks of folded towels which are delivered thereto for discharge from the folder 10.

In the operation of the folder 10, an operator places shop towels singly but in succession on the first portion 22 of the feed board conveyor 20. As soon as the shop towel bridges the space between the two portions of the feed board conveyor, it is whisked rapidly forward by the second portion 24 which is moving at twice the speed of the conveyor of the first portion. It is then transferred to the overhead conveyor 82 which draws it over the flippers 80. When the forward edge reaches a position under the photocell 89, the beam reflected from the mirror-like surface of the stainless steel flipper 80 is interrupted, causing a signal pulse to be generated which advances the count in the towel counter and activates the flipper opening mechanism to cause the flippers to drop the towel onto the V-belt 74. The signal from the photocell 89 also activates the clutch/brake mechanism 90 which momentarily uncouples the drive to the drive roller 84 of the overhead conveyor 82 and brakes this conveyor during the time it takes for the flippers 80 to be opened and drop the towel onto the belt 74. When a selected number of towels have been dropped onto the belt 74 in the folded position, the towel counter generates an output signal which energizes an electric clutch in the cluth/pulley 70, and the belt 74 is driven to advance the stack of folded towels to the transition conveyor 98. This conveyor accepts the stack of towels in a vertical attitude and rotates the stack 90° to a horizontal attitude at the position of the rollers 92, 102, from whence the stack is advanced by the belt 97, now functioning as an overhead conveyor, to a position over the flippers 110. A delay timer, triggered by the pulse which activated the electric clutch 70, causes the flippers 110 to be opened after the stack of folded towels is in position thereon, thus discharging the stack onto the conveyor 122. Succeeding stacks of folded towels are discharged from the flippers 110 onto the stack(s) already present on the conveyor 122 until a preselected number of such stacks has been counted by the stack counter. At this point the stack counter generates a signal which is applied to the drive 123 of the conveyor 122, thus transporting the pile of stacks to the location of an associated typing machine (not shown) for tying into a bundle. Typically, the towels are folded in stacks of ten, five stacks to a bundle.

Figure 5:
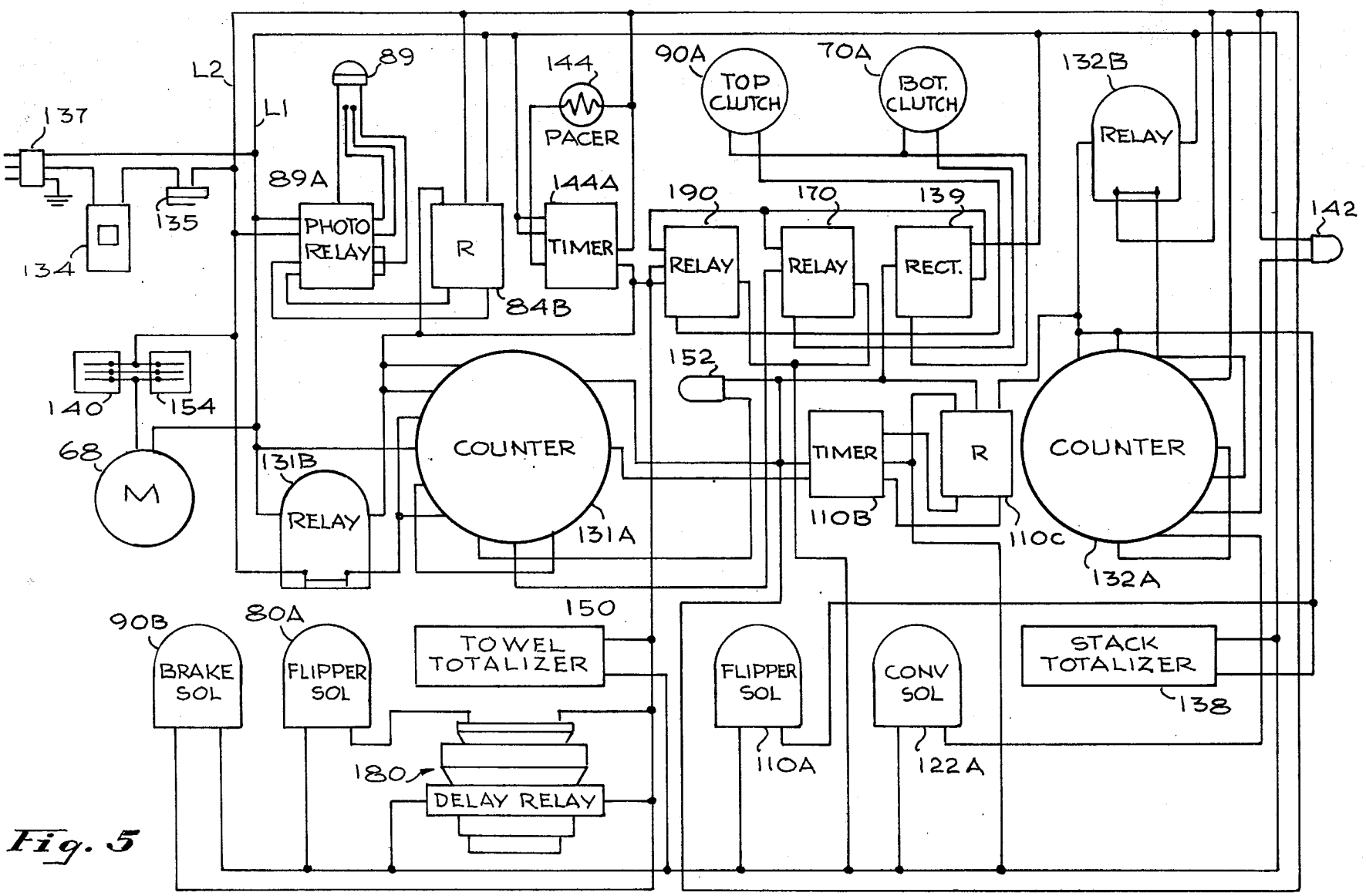
FIG. 5 is an electrical circuit diagram showing the control circuitry for for operating the embodiment of the invention.

FIG. 5 is a schematic diagram representing the elements and interconnections of the electronic timing and control circuitry for the folder 10. In this figure, the elements corresponding to those shown in FIGS. 1–3 have been designated with like reference numerals; additional elements which are associated with elements of FIGS. 1–3 have been given corresponding reference numerals followed by a letter suffix.

As shown in FIG. 5, the power switch 134 is in series with a power plug 137 and a thermal overload protector unit 135, providing AC mains power to the lines L1 and L2. A rectifier 139 is connected across the power mains for developing DC power for operation of the timers, relays and the like. Sub-control switches 140, 154, coupled in a 3-wire connection, provide separate control of AC power to the motor 68.

A photorelay 89A is coupled to the photocell 89 to provide the output signals of desired amplitude and time duration. A pacer timer 144A is coupled to receive an output signal from the photorelay 89A and to energize the pacer light 144 under the circumstances described above. The signal from the photorelay 89A is also applied to the towel counter 131A, the towel totalizer 150, a delay relay 180, a top clutch relay 190 and a brake solenoid 90B. The clutch 90A and brake solenoid 90B are associated with the brake/clutch 90 (FIG. 3) and function as described. Following a delay occasioned by the element 180, the photocell signal is applied to the flipper solenoid 80A to cause the flippers 80 to open, as previously described.

When the counter 131A counts the preselected number of individual towels being dropped onto the belt 74, an output signal is generated to energize the delay timer 110B. The delayed output of the time 110B is applied through a stabilizing resistor 110C to the counter 132A, a relay 132B, a stack totalizer 138 and a flipper solenoid 110A. Thus, after the time delay as previously described, the discharge flippers 110 are opened to discharge a stack of towels. After the stack counter 132A steps to a preselected count level, an output signal is generated and applied to the conveyor solenoid 122A associated with the conveyor 122 for transporting a bundle of towel stacks to the tying machine.

A shop towel folder in accordance with the invention has thus been shown and described, having the capability of processing shop towel folders, after laundering, with improved speed and effectiveness. The folder performs in a fashion which encourages the operator to maintain a high feed rate correlated to the processing rate of the foler. The folder is extremely reliable in operation and can be purchased for low initial cost, thus improving the efficiency of operation in the process of laundering shop towels or the like.

Although there has been described above a specific arrangement of a shop towel folder in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. A shop towel folder comprising:

a housing having opposed feed and discharge ends;

a feed board conveyor adjacent the feed end for receiving and transporting shop towels provided individually by an operator;

a further endless conveyor for receiving shop towels from the feed board conveyor and directing them in succession to a first flipper assembly, said further endless conveyor having substantially horizontally oriented upper and lower runs and said flipper assembly comprising a pair of generally flat flipper blades spaced from each other to define a gap therebetween and mounted directly below the lower run of said further conveyor, said flipper blades being pivotably mounted for rotation about axes generally parallel to the direction of movement along said further conveyor to open said gap and permit a towel to drop through, said first flipper assembly being mounted adjacent said further conveyor in position to receive shop towels therefrom individually in succession;

a photo-responsive device associated with the first flipper assembly for detecting the presence of a shop towel thereon;

a narrow folding belt longitudinally aligned with and below said gap for receiving shop towels dropped thereon one at a time in succession to form a stack, said belt being significantly narrower than the width of the shop towels so that as a towel is dropped through said gap a portion of it will be intercepted by the folding belt, thereby causing the towel to fold about a generally longitudinal center line of the towel and the folding belt;

means for selectively driving the folding belt longitudinally to deliver the folded towels by stacks to a succeeding transition conveyor at intervals corresponding to a preselected count of towels in a stack as determined by signals from said photo-responsive device;

a transition conveyor positioned to receive stacks of folded towels delivered by the folding belt in a vertical orientation and to deliver said stacks to a second flipper assembly in a horizontal orientation for discharge at the discharge end; and means for selectively driving said further conveyor and for selectively activating the flipper assemblies in accordance with predetermined control and timing signals.

2. The apparatus of claim 1 further including settable means for counting the towels in a stack on the folding belt in response to signals from the photo-responsive device and for energizing the driving means to the folding belt only when a predetermined number of towels in a stack has been counted.

3. The apparatus of claim 2 wherein the folding belt driving means includes a selectively actuable mechanism for driving the folding belt in response to a signal from an associated towel counter.

4. The apparatus of claim 1 wherein the feed board conveyor comprises first and second sections, the first section being adapted to receive shop towels placed thereon by an operator and including a conveyor belt driven from he second section at half the speed of the second section, the second section including a conveyor belt for drawing a shop towel from the first section conveyor belt at increased speed.

5. The apparatus of claim 1 wherein the further conveyor comprises a pair of rollers and a conveyor belt overlapping the feed board conveyor and extending above the first flipper assembly in close proximity therewith to draw the shop towels onto the flipper assembly by frictional engagement from above.

6. The apparatus of claim 5 further including a selectively actuable drive mechanism coupling one of the further conveyor rollers to the drive for the feed board conveyor.

7. The apparatus of claim 1 further including means responsive to the photo-responsive device for disengaging the drive to the further conveyor and momentarily stopping said further conveyor when the first flipper assembly is being actuated.

8. The apparatus of claim 1 wherein the transition conveyor includes a pair of side-by-side conveyor belts extending from a pair of vertically oriented rollers at the input to a pair of horizontally oriented rollers at the output.

9. The apparatus of claim 8 wherein the upper one of said transition conveyor belts is extended beyond said horizontal rollers to overlap the second flipper assembly for directing a stack of folded shop towels into position on said second flipper assembly.

10. The apparatus of claim 1 further including a settable shop towel counter for responding to separate signals from the photo-responsive device indicative of the presence of a shop towel on the first flipper assembly and for providing an output signal to activate the folding belt drive means when a predetermined count level is reached, corresponding to the number of towels to be folded in a single stack.

11. The apparatus of claim 10 further including a delay timer responsive to the output signal from said counter for activating the second flipper assembly to discharge a stack of folded towels at a predetermined interval following activation of the folding belt.

12. The apparatus of claim 11 further including a second counter responsive to signals from the delay timer for counting stacks of towels discharged from the folder and means for actuating an output conveyor when a preselected number of stacks is reached.

13. The apparatus of claim 1 wherein the first flipper assembly further comprises an actuator for controlling the movement of the flipper blades, and a plurality of linking members intercoupling the actuator and the flipper blades for moving the flipper blades in synchronizisn between open and closed positions.

14. The apparatus of claim 1 further including adjustable means for selectively varying the attitude and elevation of the feed board conveyor.

* * * * *